United States Patent [19]

Law et al.

[11] 4,054,495

[45] Oct. 18, 1977

[54] ELECTRODEPOSITION OF NICKEL

[75] Inventors: Malcolm John Law; Peter James Hutchinson, both of Perivale, England

[73] Assignee: Permalite Chemicals Limited, England

[21] Appl. No.: 664,086

[22] Filed: Mar. 5, 1976

[30] Foreign Application Priority Data

Mar. 27, 1975 United Kingdom ..... 12978/75

[51] Int. Cl.[2] ..... C25D 3/16

[52] U.S. Cl. ..... 204/49

[58] Field of Search ..... 204/49, 43 T, 112

[56] References Cited

U.S. PATENT DOCUMENTS

| | | | |
|---|---|---|---|
| 3,546,081 | 12/1970 | Law | 204/49 |
| 3,711,384 | 1/1973 | Lyde | 204/49 |
| 3,804,727 | 4/1974 | Lyde | 204/49 |

*Primary Examiner*—G. L. Kaplan

*Attorney, Agent, or Firm*—William Anthony Drucker

[57] ABSTRACT

The invention relates to aqueous solutions for bright and semi-bright nickel electroplating. The bath contains known ingredients such as nickel salts, boric acid ions together with three acetylenic compounds viz acetylenic alcohol, separated mono and/or di-alkoxylated derivative of acetylenic alcohol produced by reaction of acetylenic alcohol with ethylene oxide, propylene oxide or butylene oxide and N-di-substituted aminopropyne or its hydrochloride.

4 Claims, No Drawings

ELECTRODEPOSITION OF NICKEL

This invention relates to the electrodeposition of nickel.

The main object of the invention is to produce a combination of the following:

1. Good ductility of the nickel deposit
2. Good levelling of the nickel
3. Uniformity of colour and thickness of deposit with wide variation of current density
4. Tolerance as to temperature and pH over long periods of factory operation.

A further object of the invention is to produce nickel deposits with good acceptance of additional coatings of nickel or chromium.

It is well known from previously published work that the addition of acetylenic materials to nickel plating solutions can bring about improvements in brightness and levelling. British Patent Specification No. 747,908 enumerates some of the materials.

When compounds referred to in British Patent specification No. 747,908 are added to the classical Watts nickel solution at pH 4.2 temperature 55°-55° C semi-bright columnar deposits of nickel are obtained.

A Watts nickel bath contains a nickel salt, chloride or bromide ions and boric acid ions. For example a Watts solution may contain 300 grams/liter nickel sulphate 50 grams/liter nickel chloride and 40 grams/liter boric acid. When acetylenics were added in concentration within the range 0.1-0.3 grams/liter, the appearance of the deposits were semi-bright in nature with rather inferior levelling characteristics. When measured by "Talysurf" instrument for measuring levelling on a deposit 0.0005 inch thick having been plated at 40 amps per square foot the percentage levelling was found to be only 50%.

If sulpho-oxygen compounds are added to similar solutions e.g. sulpho-oxygen compounds such as saccahrin (ortho benzoic sulphinimide) or naphthalene trisulphonic acid sodium salt, bright deposits are obtained with a laminar structure which are suitable for plating over a semi-bright columnar coating. Other suitable sulpho-oxygen compounds are enumerated in British specification patent No. 1,143,257. The sulpho-oxygen compounds are added at concentrations of 1-5 grams per liter. When the levelling characteristics are checked using the same conditions as for the semi-bright deposits levelling percentages of 45-50% are obtained.

Considerable work has been carried out during the period since British Patent specification No. 747,908 was published by many workers in many countries. The aim has always been to improve brightness and levelling. There are published many claims for processes having improved levelling and brightening utilising new derivatives of acetylenes. Whilst the claims have been made for improved processes they have not met with commercial success due to production problems. This is probably due to the use of derivatives which are not complete derivatives but only partially reacted or in some cases due to the presence of free reactant which could be polymerised in the bath solution. For example in a stoichometric reaction involving 1 mole of acetylene compound with one or more moles for example of ethylene oxide the excess ethylene oxide used, polymers may be produced. In addition using this type of technique one can never guarantee that the reactant product is the same for successive batches.

According to the present invention a nickel electroplating bath contains a. Nickel sulphate
b. Chloride and/or bromide ions
c. Boric acid
d. Acetylenic alcohol
e. Separated mono and/or di-alkoxylated derivatives of acetylenic alcohol produced by reaction of acetylenic alcohol with ethylene oxide, propylene oxide or butylene oxide
f. N-di-substituted amino acetylene or their hydrochloride derivatives.

Compounds (d) and (e) are produced commercially on a large scale with quality control at all points of production. The compound (e) is "separated" i.e. is substantially pure mono and/or di-alkoxylated compound in the absence of various other compounds produced by the initial reaction of acetylene alcohol with the oxide. It is important to use these substantially pure compounds as otherwise uniformity of operation with successive patches of materials cannot be ensured.

Compounds (f) are produced as outlined in British patent specification No. 1,143,257 i.e. by reacting the acetylene amine with concentrated hydrochloric acid at low temperatures, e.g. minimum 4 liters diethylamino propyne with 1 liter water, cool to 5° C, add concentrated hydrochloric acid (about 3.5 to 4 liters) to produce a pH of 2.8 to 3.2. The final product is quality controlled using spectrophotomeric techniques to ascertain that the product is consistant.

The total concentration of acetylenic materials used is 0.01 to 0.5 e.g. 0.25-0.3 grams per liter. The concentration of the individual acetylenics can be varied throughout this range dependant upon the finish required and should be a minimum of 0.005 for (d) and (e) and at least 0.0005 for (f). We have found the optimum results the following combination is satisfactory.

0.1 to 0.2 e.g. 0.14 gms/liter of (d) e.g. 2 Butyne 1:4 diol or Butlyne 3 ol.

0.1 to 0.2 e.g. 0.15 gms/liter of (e) e.g. Di Ethoxylated Butyne Diol or mono ethoxylated propargyl alcohol.

0.001 to 0.003 e.g. 0.002 gms/liter of (f) e.g. Dimethyl (or diethyl) amino propyne hydrochloride.

Variations of acetylenics within this range produces similar results.

Levelling of 70% with an excellent ductility was obtained from a bath containing:

Nickel sulphate: 275 g/liter
Nickel chloride: 37.5 g/liter
Boric acid: 40 g/liter
Mono Ethoxylated Propargyl Alcohol: 0.15 gms/liter
Butlyne 3 01: 0.13 gms/liter
Diethyl amino propyne hydrochloride: 0.0015 gms/liter The solution operated at 55° C and pH 4.2. Cathodic current density of 40 amps per square foot gave 70% levelling at thicknesses of 0.0005 inch. To further improve the ductility use was made of the sodium salts of aryl carboxylic acids e.g. sodium benzoate. The quantity may be .05 to 0.5 g/liter. The ductility figure measured by means of the test outlined below was 0.45 where 0.5 is a maximum.

DUCTILITY TEST

Using a 6 inches × 4 inches Stainless Steel plate prepare a nickel foil of approximately 0.001 inch thick.

After plating the foil remove from the Stainless Steel sheet and accurately measure by means of a micrometer the thickness and record this value as 'T'. Cut a strip 3 inches × ¼ inch from the centre of the foil bend into a U-shape whereby the outside of the U is the outside of the plate. Place between the jaws of the micrometer and commence to close the jaws. Cracking of the deposit is indicated by an audible crack or by the resistance being released. Read the micrometer and record the reading as 2R Ductility value = T/2R T = Thickness of deposit 2R = Micrometer reading when foil cracked.

The maximum ductility measurable by this method is when 2R ≡ 2if T = 0.001 then at maximu ductility 2R = 0.002

Ductility value = T/2R = 0.001/0.002 = 0.5

Typical ranges for various nickel systems are

Semi-Bright Nickel: 0.3 - 0.5 Ductility value.

Bright Nickel: 0.1 - 0.4 Ductility value.

With reference to Table 1 it will be seen that for given concentrations of acetylenic materials a widely differing set of results are obtained. The base nickel solution used was a Watts nickel solution operated at pH 4.2 and 55° C with a cathodic density of 40 amps per square foot. We were interested in three factors which determine whether or not a process is a commercial proposition they are, levelling, ductility, appearance over the whole current density range. The ductility foils were plated in 5 gallon tanks as were the levelling test pieces. For looking at the appearance of the deposit we utilised the Hull cell 267 millimeter capacity. The acetylenic materials were tried initially on their own and then in combination. It soon became apparent that combinations of two or more acetylenic materials gave improved results particularly with respect to levelling and ductility. However, the appearance of the Hull cell panel indicated lack of deposition of plating in the low current density.

Utilising the Watts nickel base solution 50 gallon tanks of solution were set up to try the various combinations of acetylenic materials. Whilst initially combinations of the acetylene alcohols together with the mono and Di-Ethyoxylated derivatives gave excellent bright deposits of good levelling and ductility it was found that as they were worked the appearance began to fall off. The defect produced was one of "feathering" (i.e. light and dark coloured areas) in the mid to low current density particularly where there was a variation of surface or agitation of solution. No matter what was done to the solution in terms of temperature, agitation and pH the fault still persisted. Subsequent overplating with a bright nickel as would be done in commercial practice failed to remedy the fault. Having found that a combination of two acetylenic materials gave a better finish than one other combinations of the acetylenics were tried i.e. two ethoxylated derivatives and an acetylenic alcohol and vice versa. In all cases after a period of working the defect arose. Only when the concentration of material was reduced by 50% did the defect disappear however, there was the expected fall off in levelling. Materials of the series amino-acetylene hydrochlorides were now tried. When utilised at the concentrations of the acetylenic alcohols and derivatives of the acetylenic alcohols poor deposits were obtained i.e. poor ductility and skip in the low C.D. However, when very small amounts 0.001–0.003 gms/liter were added to the baths previously tried excellent well levelled and ductile deposits were obtained. Figures for these combinations are set out below.

TABLE

| MATERIAL | CONCENTRATION | DUCTILITY | LEVELLING | APPEARANCE OF DEPOSIT |
|---|---|---|---|---|
| Butyne 1:4 Diol | 0.15 gms/l. | 0.43 | 52% | Dull high C.D. Bright Mid and Low C.D. |
| Butyne 1:4 Diol | 0.30 gms/l. | 0.14 | 59% | Bright H.C.D. Skipping in L.C.D. Unacceptable. |
| Butyne 1-3 ol. | 0.15 gms/l. | 0.39 | 53% | Bright all over. |
| Butyne 1-3 ol. | 0.30 gms/l. | 0.11 | 61% | Severe skipping and misplate. |
| Propargyl Alcohol | 0.15 gms/l. | 0.37 | 48% | Skipping L.C.D. |
| Methyl Pentynol | 0.15 gms/l. | 0.41 | 52% | Clean. |
| Methyl Pentynol | 0.30 gms/l. | 0.09 | 64% | Severe skipping. |
| Ethoxylated Butyne Diol | 0.30 gms/l. | 0.28 | 68% | Black streaks in Mid to Low C.D. |
| Ethoxylated Butyne 1-3 ol. | 0.30 gms/l. | 0.32 | 64% | Skipped Low C.D. |
| Ethoxylated propargyl alcohol | 0.30 gms/l. | 0.41 | 59% | Black Streaks in low C.D. |
| EBD + Butyne Diol | 0.15 gms/l.<br>0.15 gms/l.<br>0.15 gms/l. | 0.43 | 69% | Bright over all the range no skip plate. |
| EBD + Butyne 1-3 ol. | 0.15 gms/l.<br>0.15 gms/l. | 0.39 | 67% | Bright over all the range. |
| EBD + Methyl Pentynol | 0.15 gms/l.<br>0.15 gms/l. | 0.37 | 70% | Bright over all the range. |
| EPA + Butyne Diol | 0.15 gms/l. | 0.30 | 65% | Clean and Bright slight skip low C.D. |
| Di Ethoxylated Butyne Diol | 0.3 | 0.34 | 65% | Streaking in current density. |
| Di Ethoxylated Propargyl | 0.25 | 0.38 | 66% | Lack of deposit at low current density. |
| Di Ethyoxylated Butyne Diol + Butyne Diol. | 0.15 | 0.42 | 70% | Bright over all the range. |
| Di methyl amino propyne hydrochloride | 0.3 | 0.11 | 67% | Bright but severe skipping at low current density. |
| Di ethyl amino propyne hydrochloride | 0.25 | 0.098 | 68% | Ridged deposit. |

NOTE: E.B.D. Ethoxylated Butyne 1:4 Diol (Mono Ethoxylated)
E.P.A. Ethoxylated Propargyl alcohol (Mono Ethoxylated)

TABLE 2

| MATERIALS | CONCENTRATION gms/l. | DUCTILITY | LEVEL-LING | APPEAR-ANCE |
|---|---|---|---|---|
| EBD + Butyne Diol DMAP HCl. | 0.15, 0.15 0.002 | 0.46 | 73% | Bright over all range |
| EDB + Butyne Diol + DEAP | 0.15, 0.15 0.002 | 0.43 | 71% | Bright over all range |
| EPA + Butyne 1-301 DMAP | 0.15, 0.15 0.001 | 0.44 | 70% | Bright over all range |
| EBD + Methyl Pentynol DMAP | 0.14, 0.16 0.003 | 0.43 | 69% | Bright over all range |

E.B.D. DiEthoxylated Butyne Diol.
DMAP HCl. Dimethyl Amino Propyne Hydrochloride.
DEAP HCl. Diethyl Amino Propyne Hydrochloride.
E.P.A. MonoEthioxylated Propargyl Alcohol.

Not only did the utilisation of these amino acetylenes overcome the problem of feathering (areas of varying brightness), but they also imparted to the solution much wider tolerances with respect to temperature (e.g. 120°-145°) and pH (e.g. 3.5 to 4.7) yet still maintaining bright deposits. Deposits produced from plating baths of the above formulation are ideally suited as the base layer of duplex nickel plating systems (semi-bright columnar coating covered with laminar type nickel plating). Adhesion between the deposits is excellent and due to the fact that these combinations of acetylenes can be utilised in bright nickel formulations there is no problem of carry over. When in fact these acetylenic combinations were utilised in conjunction with sulpho-oxygen compounds of the type listed in British patent specification No. 1143257 deposits having levelling figures of 68-72% with a ductility of more than 0.25 are consistantly produced with tolerance to current density, pH and temperature during long periods of operation. We have found on operation of the bath that whilst the levelling characteristics are perfectly satisfatory an addition of 1-2 gms per liter of sodium allyl or vinyl sulphonate is beneficial in giving easier controlled conditions of temperature and pH. As it is well known sodium allyl or vinyl sulphonates are classical well known levelling agents; however, we are utilising them for their property of producing good deposits on inferior pretreatments i.e. their capability to overcome pitting. Whilst all of the compounds in Table III give good ductility figures we have found that the best consistant results are obtained using saccharin "ortho benzoic sulphinimide" particularly when operating a high chloride solution. As with the semi-bright nickel process if we merely used combinations of the acetylenic alcohols and the mono and di-alkoxylated derivatives we obtained good levelling and ductility but the deposit in the mid to low current density was dark in nature. The fault could be overcome by reducing the concentration of acetylenics but at the expense of levelling.

Small additions as before of amino acetylene hydrochlorides gave satisfactory clean deposits of good ductility with the added benefit of excellent levelling. Chrome reception by bright nickel coatings produced according to the present invention is excellent. Very often in commercial practice problems arise with chromium reception particularly when the concentration of additives is increased to obtain the maximum levelling and brightness. Due to the acitivity of the nickel plate, staining can occur on the plate giving rise to grey patches after chromium plating or lack of deposit in low current density areas due to high absorbance of organic materials. These problems were manifest when we tried initially the combination of acetylenic alcohols and the mono and di ethoxylated acetylenic alcohols. When however, the very small proportion of amino acetylenic hydrochlorides is used the problems are overcome. The use of wetting agents in the process is advised to build in extra tolerances. Wetting Agents of the type sodium 2 ethyl hexyl sulphate or sodium lauryl ether sulphate may be used e.g. 0.1 to 1 g/liter.

Typical bath formulations, using additives of this invention are shown below in grams per liter:

TABLE 3

| | Bath 1 | Bath 2 | Bath 3 | General Range |
|---|---|---|---|---|
| NICKEL CHLORIDE OR BROMIDE | 48.5 | 175.0 | 35.0 | - 250 |
| NICKEL SULPHATE | 295.0 | 45.0 | 285.0 | 25 - 350 |
| BORIC ACID | 40.0 | 42.5 | 42.5 | 30 - 50 |
| NAPHTHALENE TRI SULPHONIC ACID | 3.0 | | | 0 to 5 |
| SACCHARIN | | 1.5 | | 0.5 - 5.0 |
| BUTYNE DIOL | 0.2 | 0.2 | 0.15 | .05 - .3 |
| DI ETHOXYLATED PROPARGYL ALCOHOL | 0.1 | | | .05 - .2 |
| MONO ETHOXYLATED BUTYNE DIOL | | 0.1 | 0.15 | .05 - .2 |
| DIMETHYL AMINO PROPYNE HYDROCHLORIDE | | 0.002 | .002 | .0005-005 |
| DIETHYL AMINO PROPYNE HYDROCHLORIDE | 0.002 | | | 0005-005 |
| SODIUM 2 ETHYL HEXYL SULPHATE | 0.5 | 0.5 | | 0 - 4 |
| SODIUM ALLYL SULPHONATE | 1.5 | | | 0 - 4 |
| SODIUM VINYL SULPHONATE | | 1.5 | | 0 - 4 |
| pH | 4.2 | 4.0 | 4.2 | |
| TEMPERATURE | 55° C | 60° C | 55° C | |

Bath 3 is for a semi-bright coating and Baths 1 and 2 are for bright coatings.

If nickel chloride or bromide is omitted another chloride or bromide must be included e.g. sodium, potassium or magnesium, corresponding in chloride or bromide ions to 10–50 gms/liter sodium chloride or bromide. At least one of the ingredients Naphthalene tri sulphonic acid and saccharin should be included for a bright coating.

Also at least one of the ingredients sodium allyl sulphonate and sodium vinyl sulphonate should be included for a bright coating.

The temperature range is 40° to 80° C preferably 50°-65° C.

The pH range is 3 to 5.

The current density range is up to 100 amps per square foot.

The bath may be air agitated or agitated by reciprocation of the cathode.

The total nickel sulphate and nickel chloride may be 125 to 425 gms/liter. For example the sulphate may be 150–350 gms with 25–75 gms chloride or the sulphate may be 25 to 100 gms with 100–250 gms chloride.

It has previously been stated that the addition to a Watts solution of acetylenic alcohol and non-separated ethoxylated derivatives of acetylenic alcohol will give no nickel deposit below 4 amps/sq. foot whereas with the present invention good nickel coatings are obtainable at much lower current density — even as low as 0.5 amps/sq. foot which shows the remarkable synergistic effect of the three acetylenic compounds added according to this invention.

For the purpose of the present invention any acetylenic alcohol may be used for example having the formula

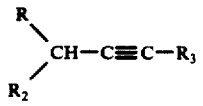

Where $R_1$ is hydroxyl, hydroxy methyl or hydroxy ethyl $R_2$ hydrogen, methyl or ethyl $R_3$ hydrogen, methyl hydroxy methyl hydroxy ethyl together with their epoxide derivatives.

What we claim is:

1. An acidic aqueous solution for nickel electroplating comprising nickel sulphate, chloride and/or bromide, boric acid, at least 0.005 gms/liter of acetylene alcohol, at least 0.005 gms/liter of separated mono and/or dialkoxylated derivative of an acetylenic alcohol produced by reaction of acetylenic alcohol with ethylene oxide, propylene oxide or butylene oxide, and at least 0.0005 gms/liter of N-di-substituted amino-propyne or its hydrochloride derivative, the total concentration of acetylenic materials being 0.01 to 0.5 grams per liter.

2. A solution as claimed in claim 1 wherein the alcohol is butyne 1:4 diol, butyne 1–3 ol, propargyl alcohol or methyl pentynol.

3. A solution as claimed in claim 1 in which the separated derivative is mono-or di-ethoxylated butyne diol or ethoxylated propargyl alcohol.

4. A solution as claimed in claim 1 which includes naphthalene tri sulphonic acid up to 5 grams/liter or saccharin 0.5 to 5.0 grams/liter, and sodium allyl sulphonate up to 4 grams/liter or sodium vinyl sulphonate up to 4 grams/liter.

* * * * *